US011532443B2

(12) United States Patent
Kralik

(10) Patent No.: US 11,532,443 B2
(45) Date of Patent: Dec. 20, 2022

(54) SWITCH DEVICE WITH IMPROVED PERMANENT MAGNETIC ARC EXTINCTION

(71) Applicant: Schaltbau GmbH, Munich (DE)

(72) Inventor: Robert Kralik, Poing (DE)

(73) Assignee: Schaltbau GmbH, Munich (DE)

( * ) Notice: Subject to any disclaimer, the term of this patent is extended or adjusted under 35 U.S.C. 154(b) by 336 days.

(21) Appl. No.: 16/496,706

(22) PCT Filed: Feb. 28, 2018

(86) PCT No.: PCT/EP2018/054940
§ 371 (c)(1),
(2) Date: Sep. 23, 2019

(87) PCT Pub. No.: WO2018/172030
PCT Pub. Date: Sep. 27, 2018

(65) Prior Publication Data

US 2020/0111624 A1 Apr. 9, 2020

(30) Foreign Application Priority Data

Mar. 23, 2017 (DE) ..... 10 2017 106 300.5

(51) Int. Cl.
*H01H 9/36* (2006.01)
*H01H 9/44* (2006.01)
(Continued)

(52) U.S. Cl.
CPC ..... *H01H 9/443* (2013.01); *H01H 9/36* (2013.01); *H01H 9/446* (2013.01); *H01H 73/18* (2013.01)

(58) Field of Classification Search
CPC ..... H01H 9/443; H01H 9/44; H01H 9/36; H01H 9/446; H01H 9/46; H01H 73/18; H01H 33/182; H01H 33/18; H01H 33/08
USPC ..... 335/201, 202; 218/22–26
See application file for complete search history.

(56) References Cited

U.S. PATENT DOCUMENTS 7,915,985 B2 * 3/2011 Schmitz ..... H01H 9/443 335/201
8,502,102 B2 * 8/2013 Eriksson ..... H01H 33/08 218/150

(Continued)

FOREIGN PATENT DOCUMENTS

CN 102683116 A 9/2012
CN 105 826 102 A 8/2016

(Continued)

OTHER PUBLICATIONS

Notice of Reasons for Refusal dated Nov. 2, 2020 in related Japanese Patent Application No. 2019-551527 (seven pages).

(Continued)

*Primary Examiner* — William A Bolton
(74) *Attorney, Agent, or Firm* — Kilpatrick Townsend & Stockton LLP

(57) ABSTRACT

Disclosed is a switch device with at least one contact point and a permanent magnetic arc blowing device which is paired with the contact point, wherein the arc blowing device has at least one second permanent magnet (15) as an auxiliary magnet, and the auxiliary magnet is arranged in the direct vicinity of the contact point (7.1), such that at least one section of the magnetic field (17) of the auxiliary magnet (15) amplifies the blow-out field in the transition region.

10 Claims, 7 Drawing Sheets

Figure 1:
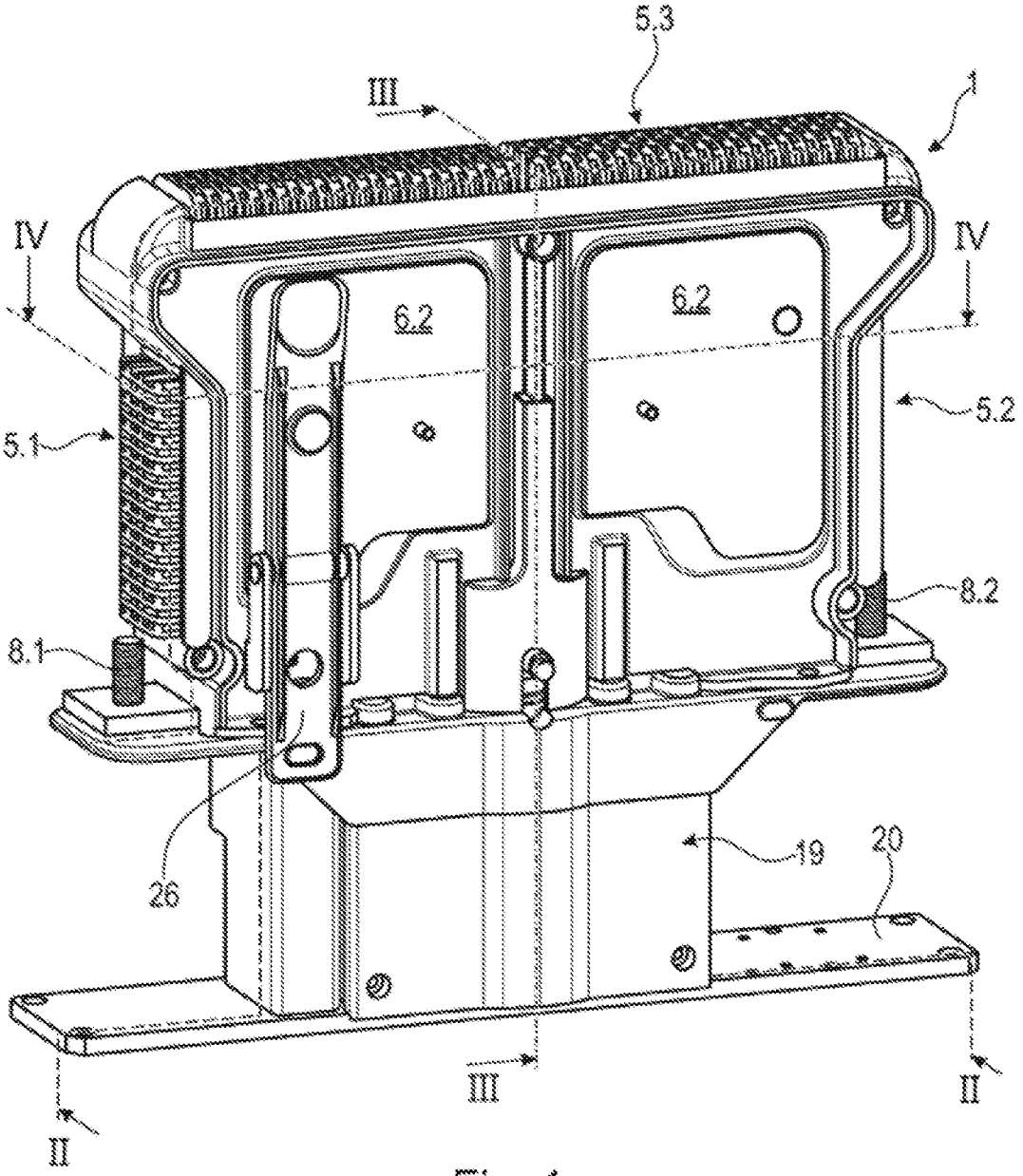

(51) Int. Cl.
*H01H 71/18* (2006.01)
*H01H 73/18* (2006.01)

(56) References Cited

U.S. PATENT DOCUMENTS

| | | | | |
|---|---|---|---|---|
| 8,853,585 | B2 * | 10/2014 | Tachikawa | H01H 9/443 335/201 |
| 8,853,856 | B2 * | 10/2014 | Damon | H01L 21/76808 257/746 |
| 9,406,465 | B1 | 8/2016 | Fasano | |
| 9,418,804 | B2 * | 8/2016 | Gerving | H01H 9/443 |
| 9,558,899 | B2 * | 1/2017 | Kreuzpointner | H01H 33/08 |
| 9,646,784 | B2 * | 5/2017 | Ignatov | H01H 33/08 |
| 2012/0145675 | A1 | 6/2012 | Zhou et al. | |
| 2012/0175345 | A1 | 7/2012 | Tachikawa et al. | |
| 2014/0319099 | A1 * | 10/2014 | Baujan | H01H 1/2025 218/23 |
| 2016/0217951 | A1 * | 7/2016 | Kralik | H01H 9/443 |

FOREIGN PATENT DOCUMENTS

| | | | | |
|---|---|---|---|---|
| DE | 27 52 765 | A1 | 5/1979 | |
| DE | 10 2015 000 796 | A1 | 7/2016 | |
| EP | 3 048 626 | A1 | 7/2016 | |
| GB | 2058463 | * | 4/1981 | H01H 33/18 |
| JP | S59-5851 | U | 1/1984 | |
| JP | S59-14219 | A | 1/1984 | |
| JP | 2016-146333 | A | 8/2016 | |
| JP | 2017-033935 | A | 2/2017 | |
| KR | 10-2016-0090770 | A | 8/2016 | |

OTHER PUBLICATIONS

Korean Office Action dated Nov. 5, 2020 in related Korean Patent Application No. 10-2019-7029655 (eight pages).
First Office Action in related Chinese Patent Application No. 201880020444.8, dated Dec. 25, 2020 (14 pages).
International Search Report dated May 24, 2018 in corresponding International Application No. PCT/EP2018/054940 (four pages).
German Search Report dated Dec. 21, 2017 in related German Patent Application No. 10 2017 106 300.5 (six pages).
Second Office Action in related Chinese Patent Application No. 201880020444.8, dated Aug. 11, 2021 with English translation (13 pages).
English Translation of Supplementary Search Report dated Aug. 3, 2021 in related Chinese Patent Application No. 201880020444.8 (three pages).

* cited by examiner

SWITCH DEVICE WITH IMPROVED PERMANENT MAGNETIC ARC EXTINCTION

This application is a US National Phase of PCT/EP2018/054940, filed Feb. 28, 2018, which claims priority to German Application No. 10 2017 106 300.5, filed Mar. 23, 2017, the entirety of which are incorporated by reference herein.

The present invention relates to a switch device according to the preamble of independent claim 1.

A generic switch device comprises at least one contact point and a permanent magnetic arc blowing device which is associated with the contact point. The arc blowing device has a first lateral pole plate, a second lateral pole plate, a central pole plate arranged therebetween, and at least one first permanent magnet for generating a magnetic blow-out field. The at least one first permanent magnet is arranged and is in contact with at least one of the pole plates either directly or via a magnetic conductor such that a first magnetic field region of the blow-out field is provided between the first lateral pole plate and the central pole plate and such that a second magnetic field region of the blow-out field is provided between the second lateral pole plate and the central pole plate, wherein the magnetic field lines of the first magnetic field region are aligned opposite the magnetic field lines of the second magnetic field region, and wherein the blow-out field additionally has a transition region which connects the first magnetic field region and the second magnetic field region together. The magnetic field lines are aligned identically in each case starting from the first magnetic field region and the second magnetic field region toward the contact point in the transition region such that a switching arc produced within the transition region upon opening the contact point is conducted either into the first magnetic field region or into the second magnetic field region depending on the current direction from the contact point and in both cases is blown away in the same direction from the contact point in said region.

The three pole plates are oriented essentially in parallel with respect to each other. As a rule, two first permanent magnets are provided, wherein the two first permanent magnets are polarized opposite with respect to each other. The two first permanent magnets may be paired either each with one of the two lateral pole plates, or else they may be arranged on the opposite sides of the central pole plate. The two lateral pole plates are, for example, connected each with the central pole plate, for example via a magnetic conductor or return. The first permanent magnets may be part of this magnetic connection or else form themselves the connecting element between the lateral and central pole plates.

A switch device according to the preamble of independent claim 1 offers the advantage that a bidirectional operation of the switch device where only one single arc-extinction device is required is possible. The switching arc is, after being deflected into the first or second magnetic field region depending on the current direction, always blown away from the contact point in the same direction, independent of the current direction, such that the switching arc may be extinguished in one and the same arc-extinction device independent of the current direction. The arc-extinction device required for this may be of any design and is not the subject matter of the present application. It may be, for example, a conventional arc-extinguishing chamber with a plurality of ceramic extinguishing elements or extinguishing plates. Since the blow-out field is generated in a merely permanent magnetic manner, no blow-out coils are required. The generic switching devices are therefore relatively compact, of light weight and moreover also inexpensive.

A generic switch device is known, for example, from DE 10 2015 000 796 A1, EP 3048626 A1, and US 2012145675 A1.

The problem with existing switch devices of the generic type is that a reliable function of the switch device may only be ensured up to a certain switching power. As the switching power increases, the switch devices have to be of a corresponding larger design. In this case, it is increasingly difficult to control the switching arc and to direct it into the respective correct magnetic field region. The use of more powerful permanent magnets for building the blow-out field is basically possible, however, it considerably increases the manufacturing costs as of a certain degree.

The object of the present invention is therefore to further develop a switch device of the generic type such that, with a correspondingly larger design of the switch device, a reliable behaviour of the arc progression may be ensured. An inexpensive manufacture of the switch device is to be still possible.

The invention is achieved by the features of independent claim 1. Accordingly, with a switch device according to the preamble of independent claim 1, a solution of the object according to the invention is given if the arc blowing device comprises at least one second permanent magnet as an auxiliary magnet, wherein the auxiliary magnet is arranged in the direct proximity of the contact point such that at least one section of the magnetic field of the auxiliary magnet amplifies the blow-out field in the transition region.

The solution according to the invention permits, in a particularly inexpensive manner, a reliable behaviour of the arc progression with a correspondingly large design of the switch device.

It should be emphasised that the auxiliary magnet has a different function from that of the first permanent magnet(s). The first permanent magnet(s) is (are) paired with at least one of the three pole plates and is (are) therefore, either directly or via a corresponding magnetic return, in magnetic connection with the corresponding pole plate. This is not the case with the auxiliary magnet in the sense of claim 1 of the present invention. The auxiliary magnet is not in direct contact with any of the three pole plates and is neither connected with the pole plates via a corresponding magnetic conductor. The function of the auxiliary magnet is to cause an amplification of the magnetic field only in the transition region of the magnetic blow-out field. This amplification is restricted to the transition region and does not relate to the first or second magnetic field region.

Advantageous embodiments of the present invention are the subject matter of the subclaims.

According to a preferred embodiment of the present invention, the auxiliary magnet is arranged such that it is, with respect to a plane of symmetry of the arc blowing device defined by the plane of extension of the central pole plate, plane-symmetrical. In this manner, a symmetric amplification of the magnetic field is caused in the transition region. Since the auxiliary magnet is arranged so-to-speak centrically, in particular with respect to the contact point and the arc blowing device, the amplification takes place in the particularly critical region, that is where the arc is formed.

Here, it is particularly advantageous for a magnetizing device of the auxiliary magnet to include a right angle both to the magnetic field lines of the first magnetic field region and to the magnetic field lines of the second magnetic field region.

In the most simple case, only one single auxiliary magnet is provided. However, a plurality of auxiliary magnets may also be arranged such that they each amplify one section of the transition region of the magnetic blow-out field.

An inexpensive manufacture of the switch device according to the invention results if standard components can be used for the auxiliary magnet. Advantageous permanent magnets have a cuboid or cylindric shape, according to a further embodiment of the present invention, the auxiliary magnet may, however, also represent a ring segment and be radially magnetized. In this embodiment, an amplification of the magnetic blow-out field is possible in a relatively large section of the transition region if one single auxiliary magnet is used. Basically, the auxiliary magnet may also be embodied such that it amplifies the magnetic blow-out field in the complete transition region. In this case, the auxiliary magnet would be a ring segment extending over 180°.

According to a further, particularly preferred embodiment of the present invention, two auxiliary magnets are provided, wherein the two auxiliary magnets are arranged, with respect to the plane of symmetry of the blow-out device defined by the plane of extension of the central pole plate, symmetrically with respect to each other. In this embodiment, a relatively large section of the transition region may be amplified by using inexpensive standard permanent magnets.

In a particularly preferred manner, the direction of magnetization of the two auxiliary magnets in this case each includes an angle to the plane of symmetry that is larger than 0° and smaller than 90°. Furthermore preferred, the angle is in a region between 5° and 45°. Particularly preferred, the angle is in a region between 5° and 30°.

According to a further preferred embodiment of the present invention, the contact point comprises a first contact and a second contact, wherein the first and the second contacts may be contacted with each other upon actuation of the switch device, and wherein the auxiliary magnet is arranged on the side of the first or second contact that is facing away from the respective other contact. In this embodiment, the auxiliary magnet may be arranged such that a section of its magnetic field amplifies the blow-out field in the transition region, while the remaining section of the magnetic field of the auxiliary magnet does not have a negative influence on the blow-out field. The contacts preferably consist of a non-magnetic metal, preferably of copper. They therefore have no influence at all on the magnetic field of the auxiliary magnet.

According to a further embodiment of the present invention, the auxiliary magnet may be easily firmly connected with the respective contact. For example, the auxiliary magnet may be glued or screwed to the corresponding contact. In a particularly preferred manner, the auxiliary magnet is, however, retained in a corresponding recess of a housing of the switch device. The housing may consist, for example, of plastics.

According to another preferred embodiment of the present invention, the auxiliary magnet is a rare-earth magnet.

Figure 2:
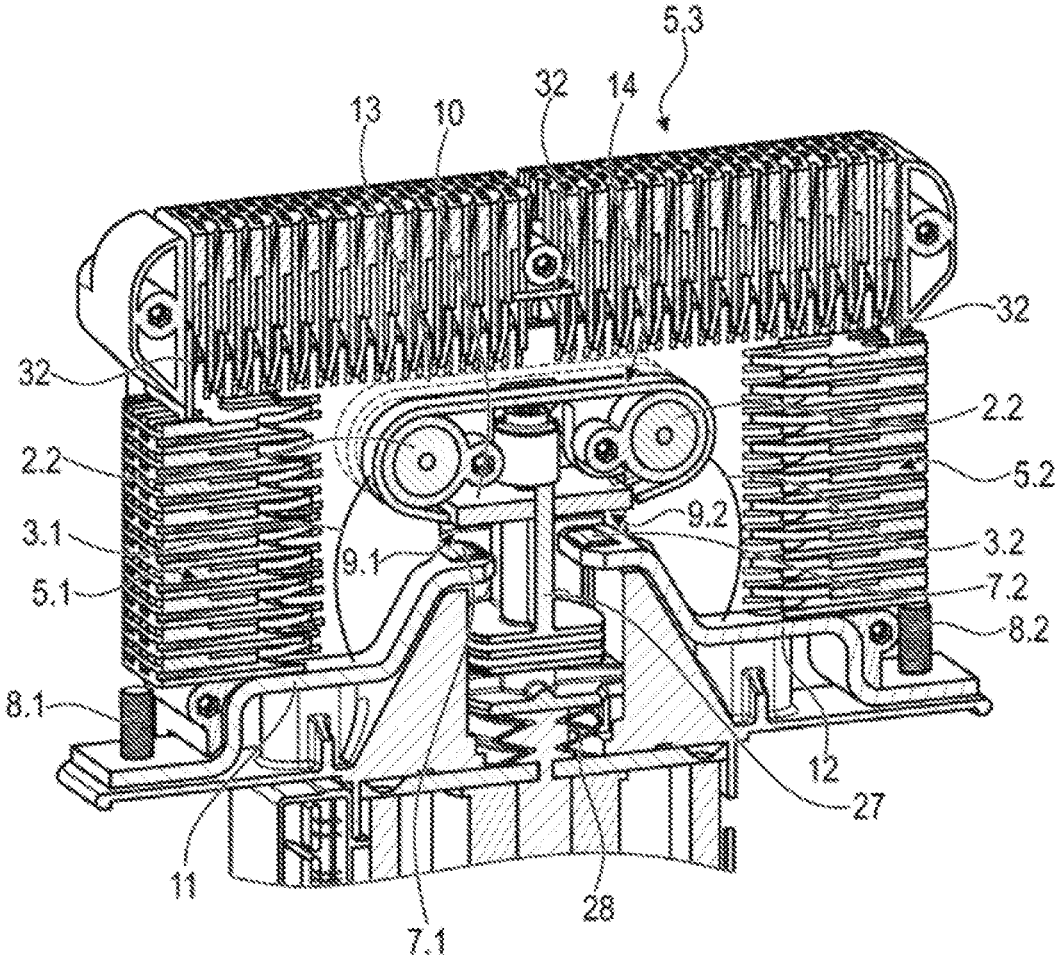
Figure 3:
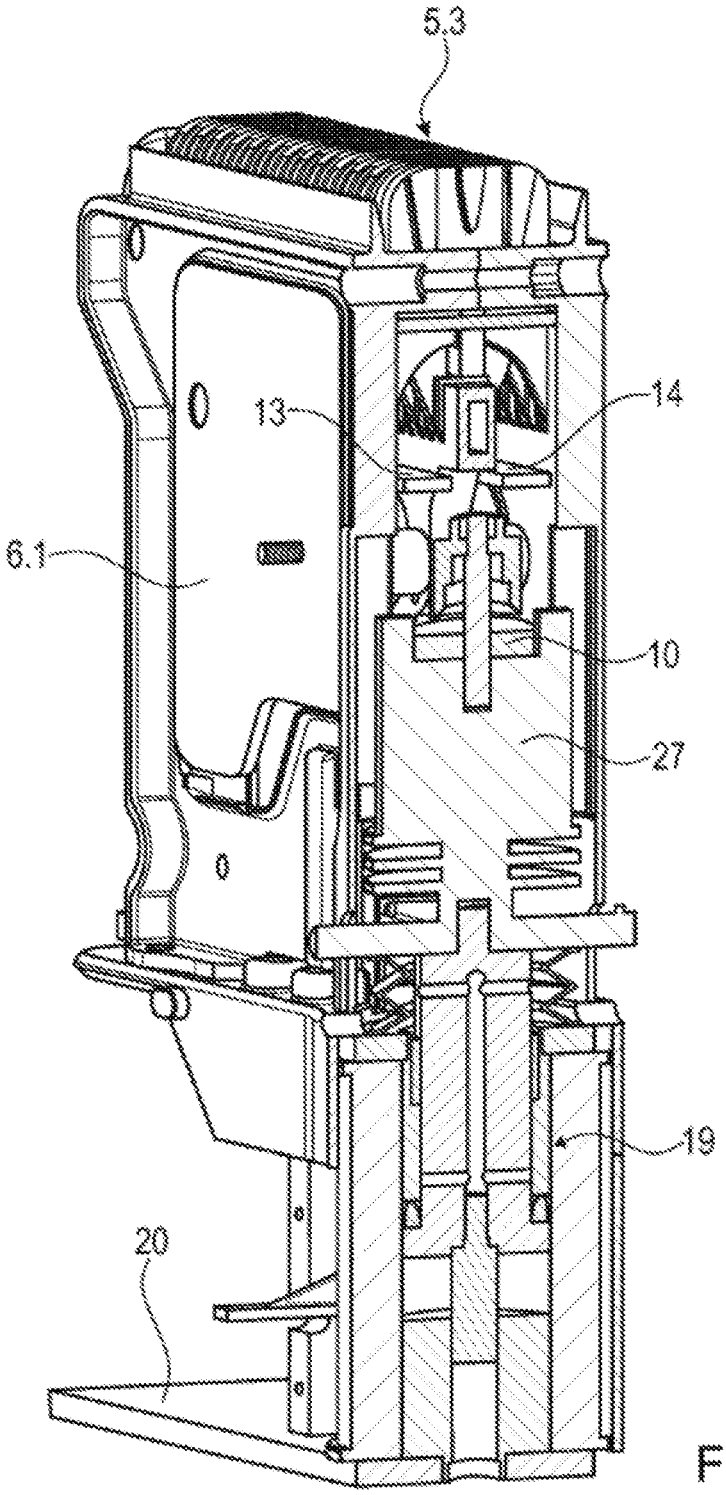
Figure 4:
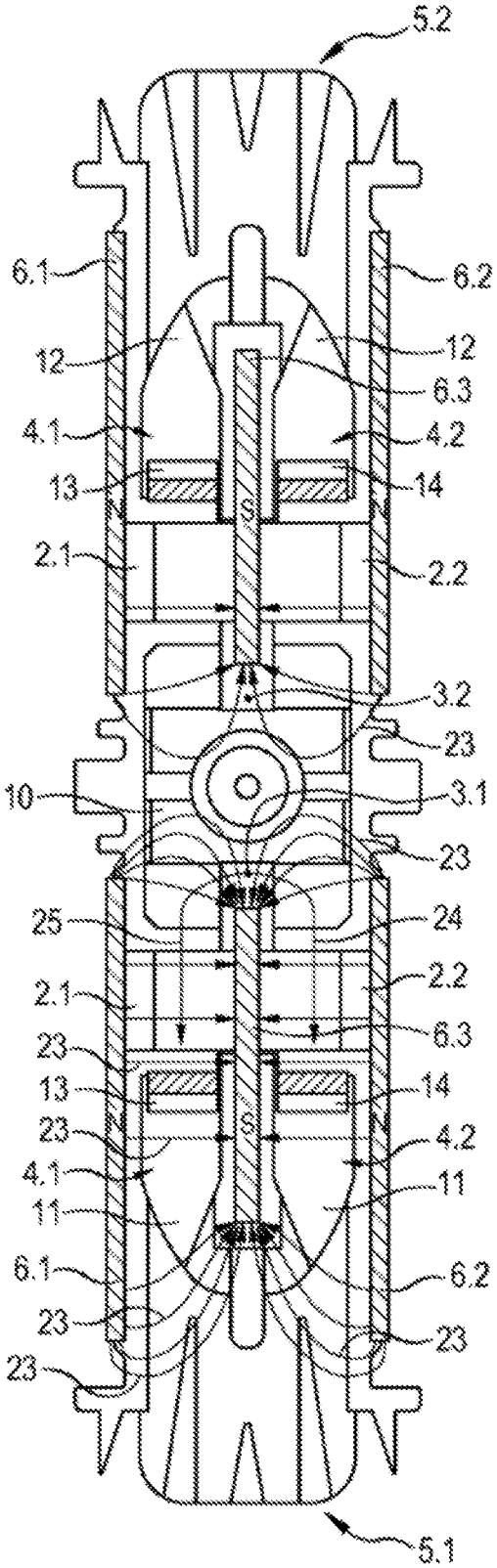
Figure 5:
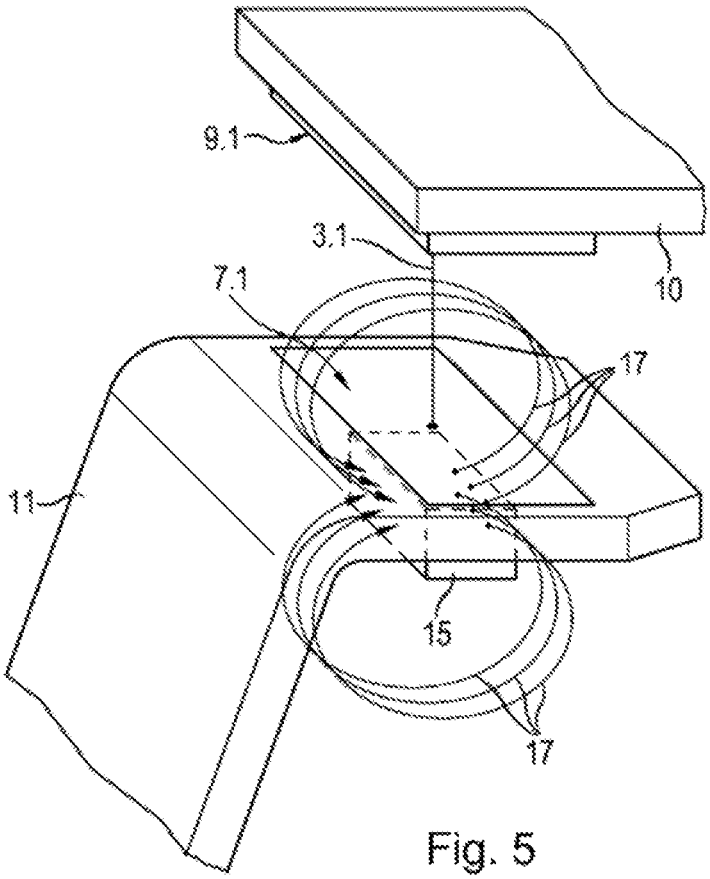
Figure 6:
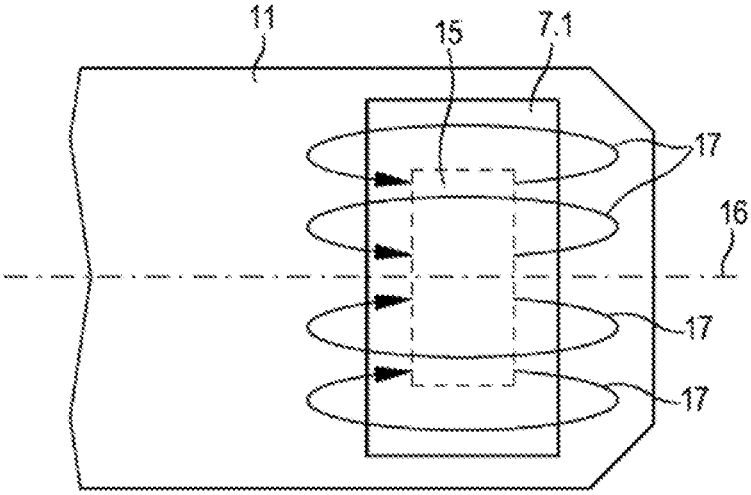
Figure 7:
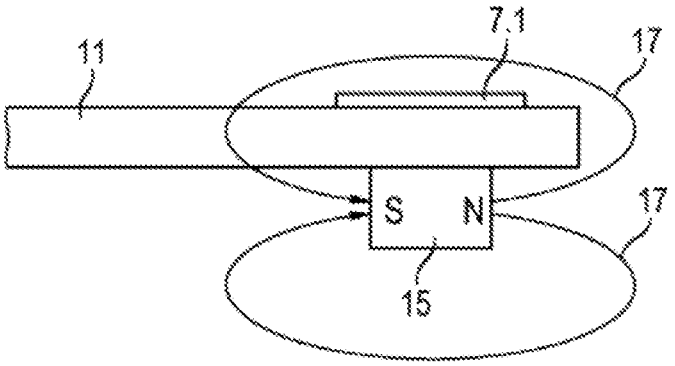
Figure 8:
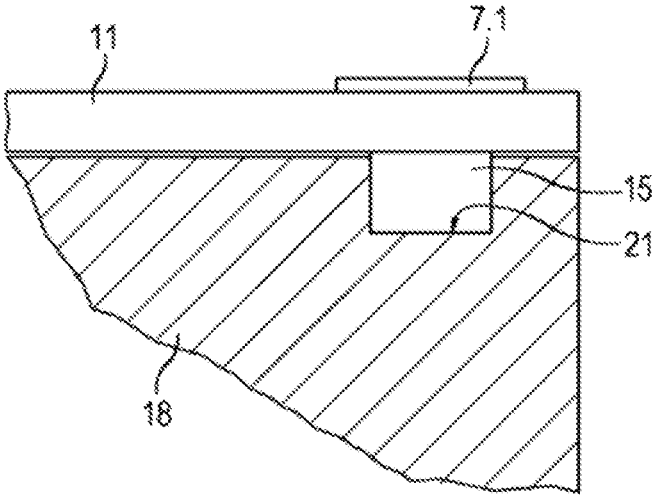
Figure 9:
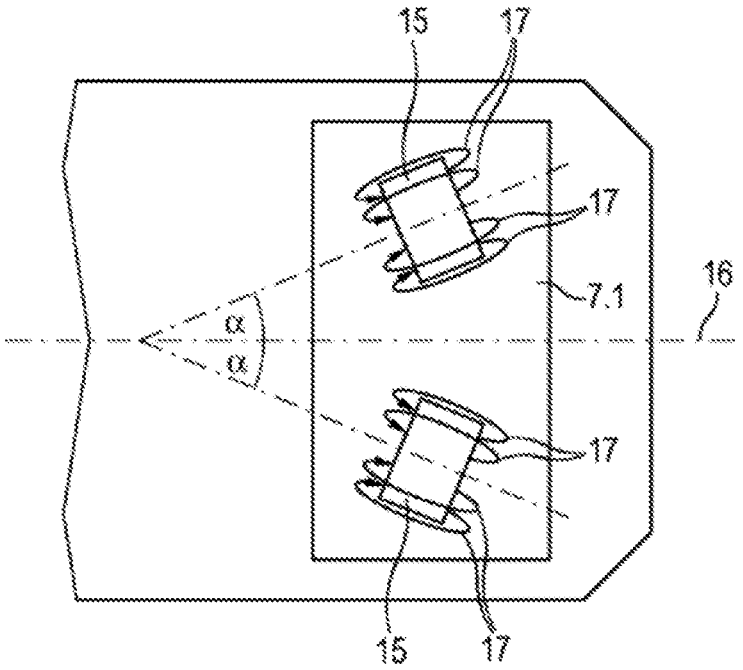
Figure 10:
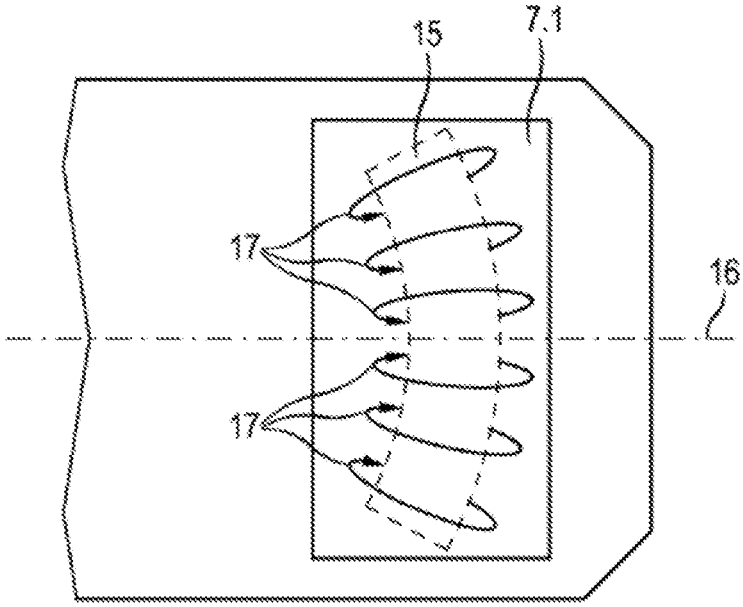

Embodiments of the present invention will be illustrated more in detail below with reference to drawings. In the drawings:

FIG. 1 shows a diagonal view of a switch device according to the invention,

FIG. 2 shows a section through the switch according to the invention of FIG. 1 along the intersection line II drawn in FIG. 1 (sectional side view), FIG. 3 shows a section through the switch according to the invention of FIG. 1 along the intersection line III drawn in FIG. 1 (longitudinal section), FIG. 4 shows a section through the switch according to the invention of FIG. 1 along the intersection line IV drawn in FIG. 1 (sectional plan view), FIG. 5 shows a detailed view of the first contact point of the switch according to the invention shown in FIG. 2 with the auxiliary magnet provided according to the invention according to a first exemplified embodiment, FIG. 6 shows a plan view onto the fixed contact of the contact point shown in detail in FIG. 5, FIG. 7 shows a side view corresponding to the plan view of FIG. 6, FIG. 8 shows a modification of FIG. 7 with an auxiliary magnet retained in a recess of a housing of the switch device, FIG. 9 shows a plan view onto the fixed contact similar to FIG. 6 according to a second exemplified embodiment of the present invention, and FIG. 10 shows a plan view onto the fixed contact similar to FIGS. 6 and 9 according to a third exemplified embodiment of the present invention.

In the following illustrations, equal parts are designated by equal reference numerals. If a drawing contains reference numerals which are not explicitly discussed in the pertaining description of the figures, reference is made to previous or following descriptions of the figures.

FIG. 1 shows a diagonal view of a switch device 1 according to the invention. The switch device is a unipolar contactor. FIG. 2 shows a section through the switch according to the invention of FIG. 1 along the intersection line II drawn in FIG. 1. Figure III shows a section through the switch according to the invention of FIG. 1 along the intersection line III drawn in FIG. 1. Figure IV shows a section through the switch according to the invention of FIG. 1 along the intersection line IV drawn in FIG. 1.

The contactor 1 has two fixed contacts 7.1 and 7.2 that are each electrically connected with a corresponding pin 8.1, 8.2. The two fixed contacts 7.1 and 7.2 may be connected to each other in an electrically conductive manner by means of a contact bridge 10. The contact bridge 10 is actuated by the armature of an electromagnetic drive 19 and has two movable contacts 9.1, 9.2. When the contacts are being closed, the first movable contact 9.1 is placed in abutment with the first fixed contact 7.1. The second movable contact 9.2 contacts the second fixed contact 7.2. The chassis 20 of the switch device where the electromagnetic drive is attached is designated with reference numeral 20 in the figures.

When the contacts are being opened, one switching arc each is created between the first fixed contact 7.1 and the first movable contact 9.1 and between the second fixed contact 7.2 and the second movable contact 9.2.

To prevent the switch device from being damaged due to the formation of the switching arcs, the latter must be guided out of the contact zone and be extinguished. Below, the pairing of the first fixed contact 7.1 and the first movable contact 9.1 will be designated as first contact point. The pairing of the second contact 7.2 and the second movable contact 9.2 will be designated as the second contact point. The switch device includes an arc blowing device for each of the two contact points to blow away the switching arc from the contact point. Each one of the two arc blowing means is paired with one arc-extinction device 5.1 and 5.2, respectively. The two arc-extinction devices 5.1 and 5.2 are arranged at opposite sides of the housing. The first arc-extinction device 5.1 is paired with the first contact point 7.1/9.1. The second arc-extinction device 5.2 is paired with the second contact point 7.2/9.2. At the upper side of the housing, a third arc-extinction device 5.3 is furthermore arranged and paired both with the first and the second contact points. By the third arc-extinction device, the extinction potential will be increased as required. Parts of the housing that are situated between the arc-extinction devices may be protected from the arc by suited copper plates 32. All three arc-extinction devices 5.1, 5.2, and 5.3 each have several extinction elements that are alternatingly stacked one upon the other. The extinction elements consist of ceramics. They may also be designed as extinguishing plates as an alternative.

The construction of the arc blowing device will be illustrated below for the first contact point consisting of the first fixed contact 7.1 and the first movable contact 9.1. The illustration may be largely reproduced with respect to FIG. 4 alone. The blow-out field that is created by the arc blowing device is exclusively created in a permanent magnetic manner in the switch device according to the invention. No electrically driven blow-out coils are required. The two permanent magnets 2.1 and 2.2 shown in FIG. 4 form first permanent magnets in the sense of the claims. They are arranged between the first contact point and the arc-extinction device 5.1 paired with the first contact point. The first permanent magnet 2.1 is in direct contact with a first lateral pole plate 6.1 that is arranged at a side wall of the switch housing shown in FIG. 1. The second permanent magnet 2.2 is also in direct contact with a second lateral pole plate 6.2 that is arranged at the opposite housing side and is shown in FIG. 1. Between the two lateral pole plates 6.1 and 6.2, there is a central pole plate 6.3 that extends in parallel to the two lateral pole plates 6.1, 6.2 and is represented in FIG. 4. Between the two permanent magnets and the central pole plate 6.3, one magnetic return each is arranged. Both the return and the permanent magnets are of a cylindrical design.

The two permanent magnets 2.1 and 2.2 are polarized oppositely. The north pole is located each externally at the first pole plate 6.1 and the second pole plate 6.2, respectively. The common south pole is located at the central pole plate 6.3. The opposite polarization causes the magnetic field, which is built up between the second lateral pole plate 6.2 (right) and the central pole plate 6.3, to be oriented opposite to the magnetic field that is built up between the first pole plate 6.1 (left) and the central pole plate 6.3. This situation is also obvious from the magnetic field lines 23 drawn in FIG. 4.

The pole plates define two channels between them which each end, starting from the first contact point, in the arc-extinction device 5.1. Here, there is a first channel 4.1 between the first lateral pole plate 6.1 and the central pole plate 6.3. Between the second lateral pole plate 6.2 and the central pole plate 6.3, there is a second channel 4.2. The two channels are interspersed by one of the two oppositely polarized magnetic fields each transverse to their longitudinal extension. The two lateral pole plates 6.1, 6.2 laterally reach next to the contact point, the central pole plate 6.3 being somewhat shorter and ending in front of the contact point. This results in a transition region of the magnetic blow-out field at the contact point. Approximately in the centre of the fixed contact 7.1 or the movable contact 9.1, respectively, the magnetic field lines extend perpendicularly to the magnetic field lines of the two magnetic fields in the channels 4.1 and 4.2. In the transition region, the magnetic field lines are quasi fanned out over an angle of 180°. The direction of the magnetic field in the channel 4.1 is thereby reversed in the transition region until it finally corresponds to the direction of the magnetic field in channel 4.2.

If now the first pin 8.1 is connected with the positive terminal of a voltage source, during the opening of the contacts, a switching arc 3.1 is formed at the first contact point and is first deflected to the right by the magnetic blow-out field in FIG. 4 (in FIG. 4, the switching arc is located underneath the plane of projection) and subsequently enters the channel 4.2 between the second lateral pole plate 6.2 and the central pole plate 6.3. The moving direction of the switching arc 3.1 is for this case illustrated with the arrow 24. If the first pin 8.1 is connected with the negative terminal of the voltage source, the switching arc is first deflected to the left in the opposite direction. It then enters the left channel 4.1 between the first lateral pole plate 6.1 and the central pole plate 6.3 along the path illustrated by arrow 25. In both cases, the switching arc is subsequently driven into the arc-extinction device 5.1 by the magnetic blow-out field. The central pole plate 6.3 is also somewhat shorter than the two lateral pole plates 6.1, 6.2 at the opposite end that is facing the arc-extinction device 5.1. Thereby, the magnetic blow-out field also has a transition region shortly in front of the arc-extinction device 5.1 which guides the switching arc into the centre of the arc-extinction device 5.1. Thereby, the arc-extinction device 5.1 may be kept compact.

At the second contact point, which is formed by the second fixed contact 7.2 and the second movable contact 9.2, there also is an arc blowing device provided which has a design identical to that of the arc blowing device at the first contact point. The two switching arcs 3.1 and 3.2 formed at the contact points 7.1/9.1 and 7.2/9.2 are, in the representation of FIG. 4, depending on the current direction, initially deflected either both to the right or both to the left, then blown into the respective arc-extinction device 5.1 or 5.2, and thereafter also into the third arc-extinction device 5.3. Depending on the current direction, the switching arcs 3.1 and 3.2 are thus driven into the arc-extinction devices either through the channels 4.1 or, as is shown in FIG. 2, through the channels 4.2.

In FIG. 2, one can see that several so-called arc baffles are provided on the one hand to guide the switching arc and on the other hand to extend it on its way into the arc-extinction devices. The first fixed contact 7.1 is paired with a first arc baffle 11, and the second fixed contact 7.2 is paired with a second arc baffle 12. The first arc baffle 11 and the second arc baffle 12 extend between the respective fixed contacts 7.1 and 7.2 and the respective corresponding arc-extinction devices 5.1 or 5.2, respectively. They each connect the fixed contact 7.1 or 7.2 with the corresponding pin 8.1 or 8.2, respectively. The first arc baffle 11 and the second arc baffle 12 are arranged underneath the respective central pole plate 6.3 and extend with their width both over the first channel 4.1 and over the parallel second channel 4.2 of the corresponding arc blowing device. Furthermore, a third arc baffle 13 and a fourth arc baffle 14 are provided. The third arc baffle 13 and the fourth arc baffle 14 each extend in an arc from the first movable contact 9.1 to the second movable contact 9.2, such that the third arc baffle 13 and the fourth arc baffle 14 each form a nearly closed loop together with the contact bridge 10. As is shown in FIG. 2, the central pole plates 6.3 of the first and second arc blowing devices are each arranged between the third arc baffle 13 and the fourth arc baffle 14. The third arc baffle 13 is located, in the representation of FIG. 2, behind the two central pole plates 6.3 and is therefore shown in a dashed line in this illustration.

The ends of the third arc baffle 13 and the fourth arc baffle 14 are each slightly spaced apart from the ends of the contact bridge 10 such that the contact bridge 10 may be moved relative to the third and fourth arc baffles. A base of the switching arc jumps from the contact bridge to the third or fourth arc baffle, respectively, if the switching arc is blown out of the contact point. The corners of the contact bridge are preferably rounded to increase service life.

The first arc blowing-out magnet 2.1 of the first arc blowing device and the first arc blowing-out magnet 2.1 of the second arc blowing device are arranged within the loop formed by the third arc baffle 13 and the contact bridge 10, the second arc blowing-out magnet 2.2 of the first arc blowing device and the second arc blowing-out magnet 2.2 of the second arc blowing device being arranged within the loop formed by the fourth arc baffle 14 and the contact bridge 10. Thereby, the arc blowing-out magnets are shielded from the arc in a simple manner. A protective covering of the arc blowing-out magnets of ceramics or the like is not necessary.

As can be taken from FIG. 2, the contact bridge 10 is arranged with the two movable contacts 9.1 and 9.2 above the two fixed contacts 7.1 and 7.2. The electromagnetic drive 19 is located underneath the two contact points. This has the advantage that the upper part of the housing may be completely removed for maintenance permitting free access to the contacts. The locking of the upper housing parts is effected by means of the latch 26 shown in FIG. 1.

The central pole plates 6.3 of the first and second arc blowing devices are covered in an electrically insulating manner. The contact bridge 10 is arranged on a contact carrier 27 of electrically insulating material. As is shown in FIG. 3, the contact carrier 27 extends between the first contact point and the second contact point over the light width of the housing of the switch device. The contact carrier submerges into corresponding grooves of the housing on both sides such that a labyrinth-type seal barrier is formed for the plasma which is built by the arc. Underneath the contact carrier 27, a bellow 28 is furthermore arranged to prevent ground termination which otherwise occurs due to the plasma produced by the arc during arcing to the yoke plate of the drive of the switch device if correspondingly high loads are switched.

At this point, it should be noted that in addition to the two shown pole plate arrangements which are each paired with one of the two arc-extinction devices 5.1 and 5.2 and each consist of the pole plates 6.1, 6.2 and 6.3, advantageously at least one additional pole plate arrangement may be provided which is paired with the third arc-extinction device 5.3 and may additionally also be paired with regions of the two lateral arc-extinction devices 5.1 and 5.2. The pole plates of this additional pole plate arrangement preferably extend nearly over the complete length of the third arc-extinction device 5.3. The pole plates 6.1, 6.2 and 6.3 are in this embodiment somewhat smaller or end somewhat underneath the third arc-extinction device. The arc blowing-out magnets of the additional pole plate arrangement may be arranged centrically in the region of the third arc-extinction device.

FIG. 5 shows a detailed view of the first contact point of the switch according to the invention shown in FIG. 2. As is shown in the representation, in the direct proximity of the contact point, an auxiliary magnet 15 provided according to the invention is arranged which amplifies the blow-out field in the transition region. The auxiliary magnet 15 is located on the bottom side of the fixed contact 7.1 facing away from the movable contact 9.1. The magnetic field lines of the magnetic field generated by the auxiliary magnet are designated with reference numeral 17. As results from the representation in FIG. 5 and in particular from the representation in FIG. 7, only the upper part of the magnetic field is actually relevant as only this part of the magnetic field has an influence on the switching arc 3.1 formed at the first contact point 7.1/9.1.

As FIG. 6 shows, the auxiliary magnet 15 is arranged such that it is plane-symmetrical with respect to a plane of symmetry 16 of the blowing device which is defined by the plane of extension of the central pole plate 6.3. The direction of magnetization of the auxiliary magnet 15 includes a right angle to the magnetic field lines of the first magnetic field region 4.1 and to the magnetic field lines of the second magnetic field region 4.2.

The auxiliary magnet 15 may be firmly connected with the fixed contact 7.1/11. For example, gluing or screwing is possible. FIG. 8 shows a modification where the auxiliary magnet 15 is received and retained in a simple manner in a recess 21 of the housing 18 of the switch device according to the invention.

FIG. 9 shows a second exemplified embodiment where two auxiliary magnets 15 are employed per contact point. The two auxiliary magnets are arranged symmetrically with respect to the plane of symmetry 16 of the blowing device. The direction of magnetization of the two auxiliary magnets 15 includes an angle $\alpha$ to the plane of symmetry 16 that is approx. 20°.

The auxiliary magnets shown in FIGS. 5 to 9 may be designed as simple cuboid or cylindrical permanent magnets, preferably as rare-earth magnets. FIG. 10 in contrast shows a further exemplified embodiment where the auxiliary magnet 15 represents a ring segment and is radially magnetized. In this exemplified embodiment, the transition region of the blow-out field may be amplified in a relatively broad section by one single auxiliary magnet. The auxiliary magnet 15 according to the exemplified embodiment in FIG. 10, however, is more complex and therefore more expensive to manufacture than the standard magnets employed in the exemplified embodiments in FIGS. 5 to 9.

The invention claimed is:

1. A switch device comprising:

at least one contact point comprising a fixed contact and a movable contact; and one permanent magnetic arc blowing device associated with the contact point, wherein the arc blowing device comprises:

a first lateral pole plate;

a second lateral pole plate;

a central pole plate arranged therebetween; and at least one first permanent magnet to generate a magnetic blow-out field, wherein the at least one first permanent magnet is arranged and is in contact with at least one of the first lateral, second lateral, or central pole plates either directly or via a magnetic conductor such that a first magnetic field region of the blow-out field is provided between the first lateral pole plate and the central pole plate, and such that a second magnetic field region of the blow-out field is provided between the second lateral pole plate and the central pole plate, wherein magnetic field lines of the first magnetic field region are aligned opposite magnetic field lines of the second magnetic field region, and wherein the blow-out field additionally has a transition region which connects the first magnetic field region and the second magnetic field region together, wherein the magnetic field lines of the first and second magnetic field regions are aligned identically in each case starting from the first magnetic field region and the second magnetic field region toward the contact point in the transition region such that a switching arc produced within the transition region upon opening the contact point is conducted either into the first magnetic field region or into the second magnetic field region depending on a current direction from the contact point and in both cases is blown away in a same direction from the contact point in the transition region, characterized in that the arc blowing device has at least one second permanent magnet as an auxiliary magnet, wherein the auxiliary magnet is arranged in direct vicinity of the contact point and attached at an undersurface of the fixed contact located opposite to the movable contact such that at least one section of a magnetic field of the auxiliary magnet amplifies the blow-out field in the transition region.

2. The switch device according to claim 1, wherein the auxiliary magnet is arranged such that the auxiliary magnet is plane-symmetrical with respect to a plane of symmetry of the arc blowing device defined by a plane of extension of the central pole plate.

3. The switch device according to claim 1, wherein a direction of magnetization of the auxiliary magnet includes a right angle both to the magnetic field lines of the first magnetic field region and to the magnetic field lines of the second magnetic field region.

4. The switch device according to claim 1, wherein the auxiliary magnet represents a ring segment and is radially magnetized.

5. The switch device according to claim 1, wherein two auxiliary magnets are provided, wherein the two auxiliary magnets are arranged symmetrically to each other with respect to a plane of symmetry of the arc blowing device defined by a plane of extension of the central pole plate.

6. The switch device according to claim 5, wherein a direction of magnetization of each of the two auxiliary magnets includes an angle $\alpha$ to the plane of symmetry that is larger than 0° and smaller than 90°.

7. The switch device according to claim 1, wherein the fixed and the movable contacts may be brought into contact with each other upon actuation of the switch device.

8. The switch device according to claim 7, wherein the auxiliary magnet is firmly connected with the fixed contact.

9. The switch device according to claim 7, wherein the auxiliary magnet is retained in a recess of a housing of the switch device.

10. The switch device according to claim 1, wherein the auxiliary magnet is a rare-earth magnet.

* * * * *